US006616027B2

(12) United States Patent
Mochizuki

(10) Patent No.: US 6,616,027 B2
(45) Date of Patent: Sep. 9, 2003

(54) STAPLER APPARATUS THAT REMOVES ONLY JAMMED STAPLES

(75) Inventor: Naoto Mochizuki, Kofu (JP)

(73) Assignees: ACCO Brands, Inc., Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 09/873,283

(22) Filed: Jun. 5, 2001

(65) Prior Publication Data

US 2002/0017547 A1 Feb. 14, 2002

(51) Int. Cl.[7] ..... B27F 7/38
(52) U.S. Cl. ..... 227/131; 22/134; 22/136
(58) Field of Search ..... 227/120, 130, 227/131, 134, 136, 140, 152, 155, 123

(56) References Cited

U.S. PATENT DOCUMENTS

| | | | | |
|---|---|---|---|---|
| 4,570,841 A | * | 2/1986 | Olesen | 227/120 |
| 4,770,334 A | * | 9/1988 | Hoshi et al. | 227/120 |
| 4,913,332 A | * | 4/1990 | Olesen | 227/123 |
| 4,978,045 A | * | 12/1990 | Murakami et al. | 226/45 |
| 5,076,483 A | | 12/1991 | Olesen | 227/131 |
| 5,121,868 A | * | 6/1992 | Jairam | 227/123 |
| 5,230,457 A | | 7/1993 | Hiroi et al. | 227/2 |
| 5,460,314 A | | 10/1995 | Udagawa | 227/155 |
| 5,474,222 A | | 12/1995 | Kanai et al. | 227/131 |
| 5,660,314 A | | 8/1997 | Magnusson et al. | 227/2 |
| 5,791,548 A | | 8/1998 | Udagawa et al. | 227/131 |
| 6,135,337 A | | 10/2000 | Harris et al. | 227/131 |

FOREIGN PATENT DOCUMENTS

| | | |
|---|---|---|
| JP | 10-000578 | 1/1998 |
| JP | 2000-167782 | 6/2000 |

* cited by examiner

*Primary Examiner*—Scott A. Smith
*Assistant Examiner*—Nathaniel Chukwurah
(74) *Attorney, Agent, or Firm*—Michael Best & Friedrich LLP

(57) ABSTRACT

A stapler is provided that consistently remove only jammed staples from the stapler. Guide grooves are formed in a guide unit of a cartridge, and the guide grooves support a sheet of staples. Stoppers are formed on the edge of the walls of the guide unit to block the ends of the guide grooves. Release holes that open upwardly are formed in the guide grooves in front of the stoppers. Because a jammed staple protrudes from the release holes, the jammed staple can be pulled out from the release holes using the fingers. As a result, jammed staples can be effectively removed from the stapler.

20 Claims, 11 Drawing Sheets

STAPLER APPARATUS THAT REMOVES ONLY JAMMED STAPLES

TECHNICAL FIELD

The present invention relates to a stapler for applying staples to sheets of paper discharged to the sorter or finisher inside an image forming device such as a photocopier or printer.

BACKGROUND

FIG. 1 shows a cartridge used in a stapler of the prior art. The staples 1 used to staple documents are stored in a continuous sheet of staples (a). In other words, the staples 1 are fused together in a consecutive sheet of staples (a). The staples 1 are driven one by one into documents, where they are bent into an angular C-shape and severed from the sheet of staples (a). The sheet of staples (a) is wound in a roll and housed inside a cartridge 100. The cartridge 100 is equipped with a housing unit 101 for housing the rolled sheet of staples (a) and a guide unit 102 for guiding the end of the rolled sheet of staples (a) out from the cartridge 100. The housing unit 101 has an outer diameter that conforms to the rolled sheet of staples (a) and a round inner periphery.

Also, the guide 102 for guiding the sheet of staples (a) is equipped with a pair of walls 102*a*, 102*a* held apart at a given interval, and a protrusion 102*b* moving horizontally between the walls 102*a*, 102*a*.

The protrusion 102*b* has a reverse motion stopping tab 12. The reverse motion stopping tab 12 has a tip that makes contact with the sheet of staples (a) drawn out from the guide unit 102. This accommodates the sheet of staples (a) moving in the direction of the arrow in FIG. 1, but prevents the sheet of staples (a) from moving in reverse.

Guide tabs 102*c* are located in the inner surface of the walls 102*a*, 102*a*, and these guide tabs 102*c* prevent the sheet of staples (a) from rising off the base 102*h* of the guide unit 102.

The walls 102*a*, 102*a* are also equipped with tip contacting units 103, 103 for making contact with the main body of the device when the cartridge 100 is in the main body of the device. A catch 102*g* is situated on the base 102*h* of the guide unit 102 for keeping the cartridge 100 in a certain position inside the main body of the device.

In the stapler with a cartridge 100 installed, a staple 1 is driven through a stack of paper cleanly and the staple 1 is bent after the staple 1 has been applied to the stack of paper. If the stapling process does not proceed smoothly, the staple becomes jammed.

When a staple 1 becomes jammed, the staple 1 remains inside the main body of the device. If the jammed staple 1 remains inside the device, the stapling operation cannot be performed until the jammed staple is removed.

When a staple becomes jammed, the cartridge is detached from the stapler and the jammed staple 1 is removed. When the jammed staple 1 is removed, a finger is inserted under the jammed staple 1 to remove the jammed staple 1 from the sheet of staples (a).

If the jammed staple cannot be pulled away, the sheet of staples (a) has to be pulled out to an unjammed section. However, it is difficult to return the extended sheet of staples (a) to its original position. If the cartridge has a reverse motion stopping tab, then it is impossible to return the extended sheet of staples (a) to its original position.

Because the extended sheet of staples (a) cannot be returned to its original position, the extended portion has to be cut off. This results in a waste of staples.

When a jammed staple is removed from the sheet of staples (a), the unjammed staples are bent. Even slightly bent staples cannot be applied smoothly to stacks of paper. The result is even more jammed staples.

When a jammed staple is removed from the sheet of staples (a), the unjammed staples also become slightly separated. As a result of this slight separation, a blank may be fired during the stapling process.

Therefore, there remains a need for a stapler in which only jammed staples are consistently removed.

SUMMARY OF THE INVENTION

The embodiment of the present invention relates to a stapler having a housing unit for housing a sheet of staples, a cartridge forming a guide unit for supporting the sheet of staples drawn from the housing unit, and a main body for accommodating the cartridge. The main body of the device is equipped with a driver mechanism for detaching a staple from the sheet of staples and driving the detached staple through a stack of paper and a sheath bracket for guiding the driver mechanism in the direction of the driving motion. A stopper restricts the position of the end of the sheet of staples, and release holes are situated in a position corresponding to the end of the sheet of staples restricted by the stopper so the staple driven by the driver mechanism passes through in the driving direction.

In another embodiment, the stopper is situated on the tip of the guide unit for the cartridge, and the cartridge can be detached from the main body of the device.

In yet another embodiment, the stopper is situated on the sheath bracket of the main body of the device, an opening is formed in the sheath bracket, and the release holes are exposed by the opening.

In another embodiment, the stopper is situated on the driver mechanism of the main body of the device, an opening is formed in the sheath bracket used to guide the driver mechanism, a cover is formed to cover the opening, and the release holes are exposed when the cover is opened and closed.

In another embodiment the release holes are at least the size of a width of a single staple.

DETAILED DESCRIPTION OF THE PREFERRED EMBODIMENTS

Figure 1:
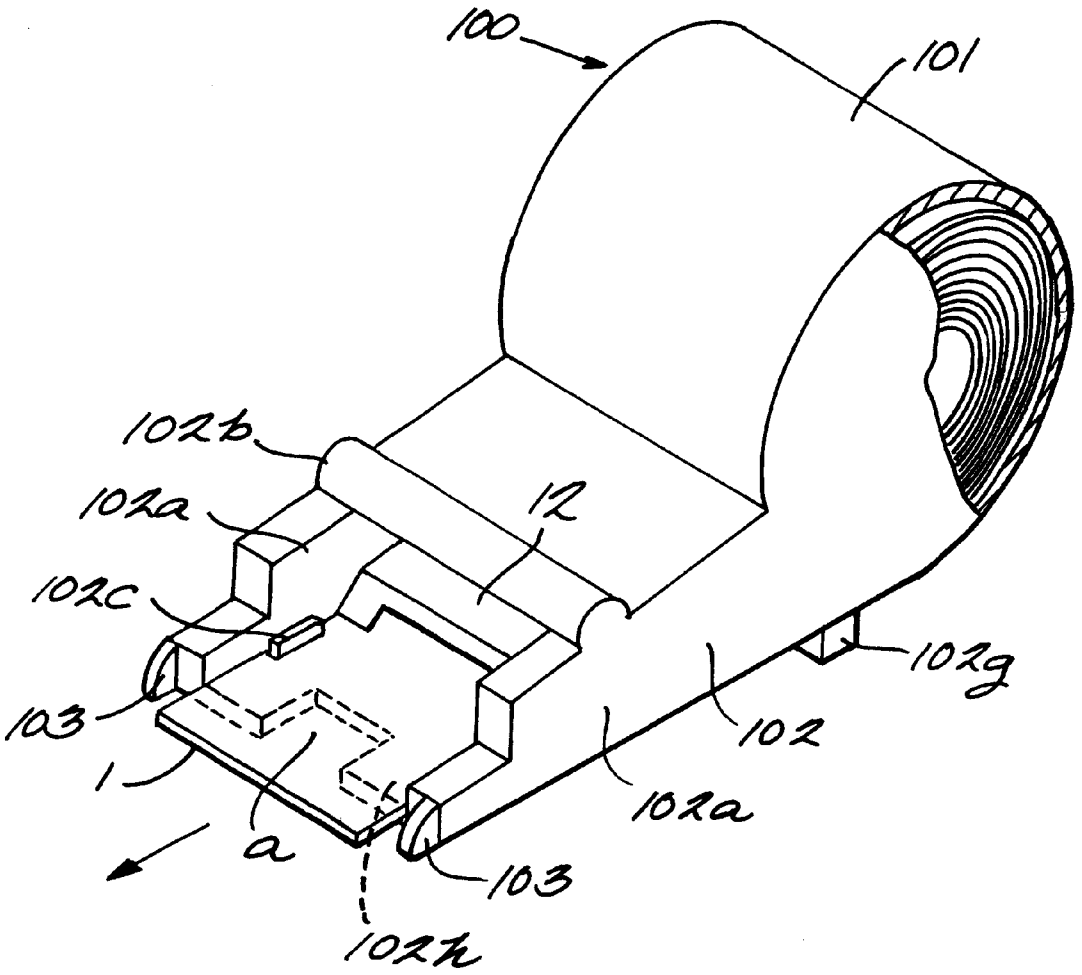
FIG. 1 PRIOR ART
FIG. 1 is a perspective view of a cartridge of the prior art.
Figure 2:
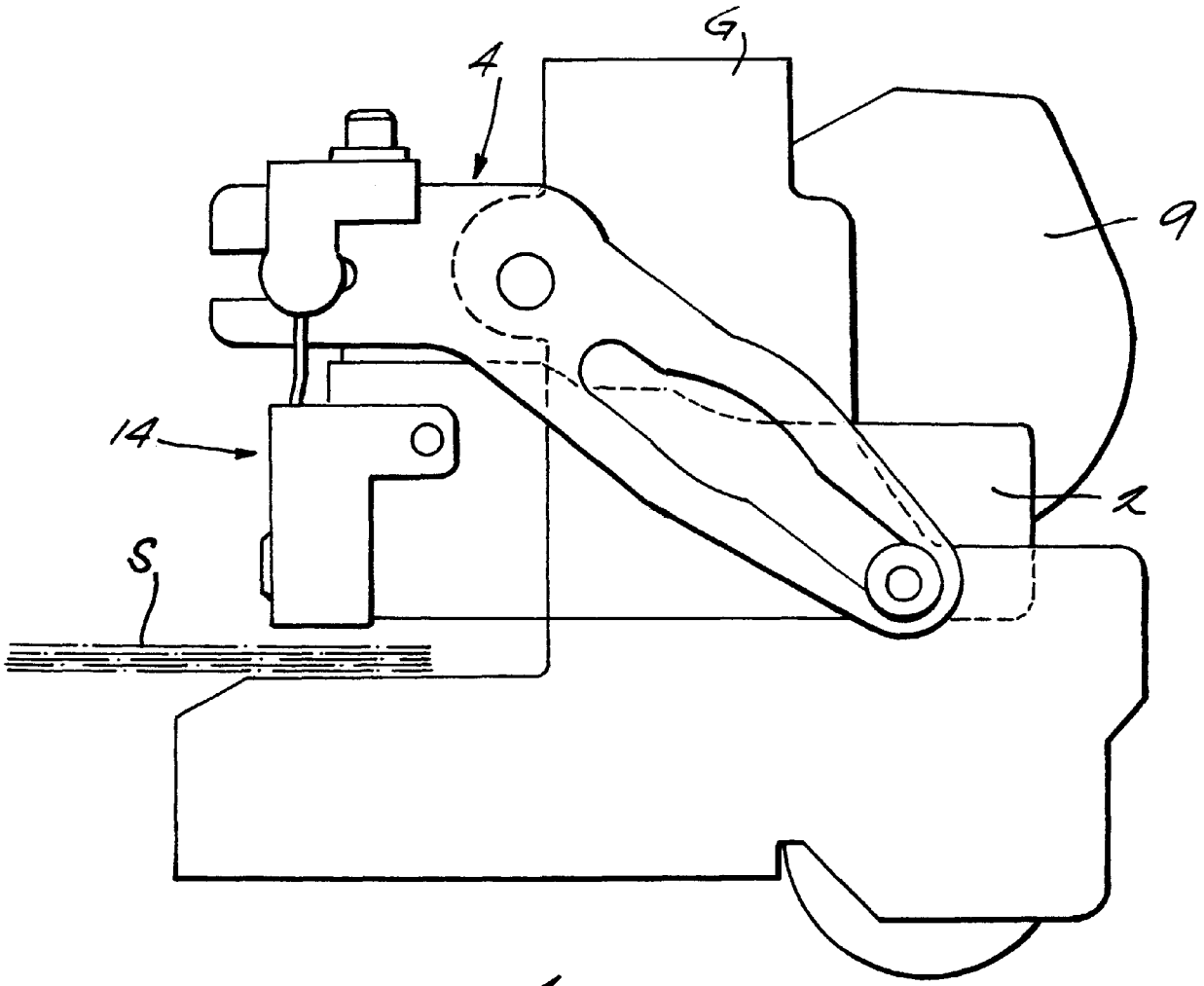
FIG. 2 is a simplified drawing of the stapler in the first embodiment of the present invention.
Figure 3:
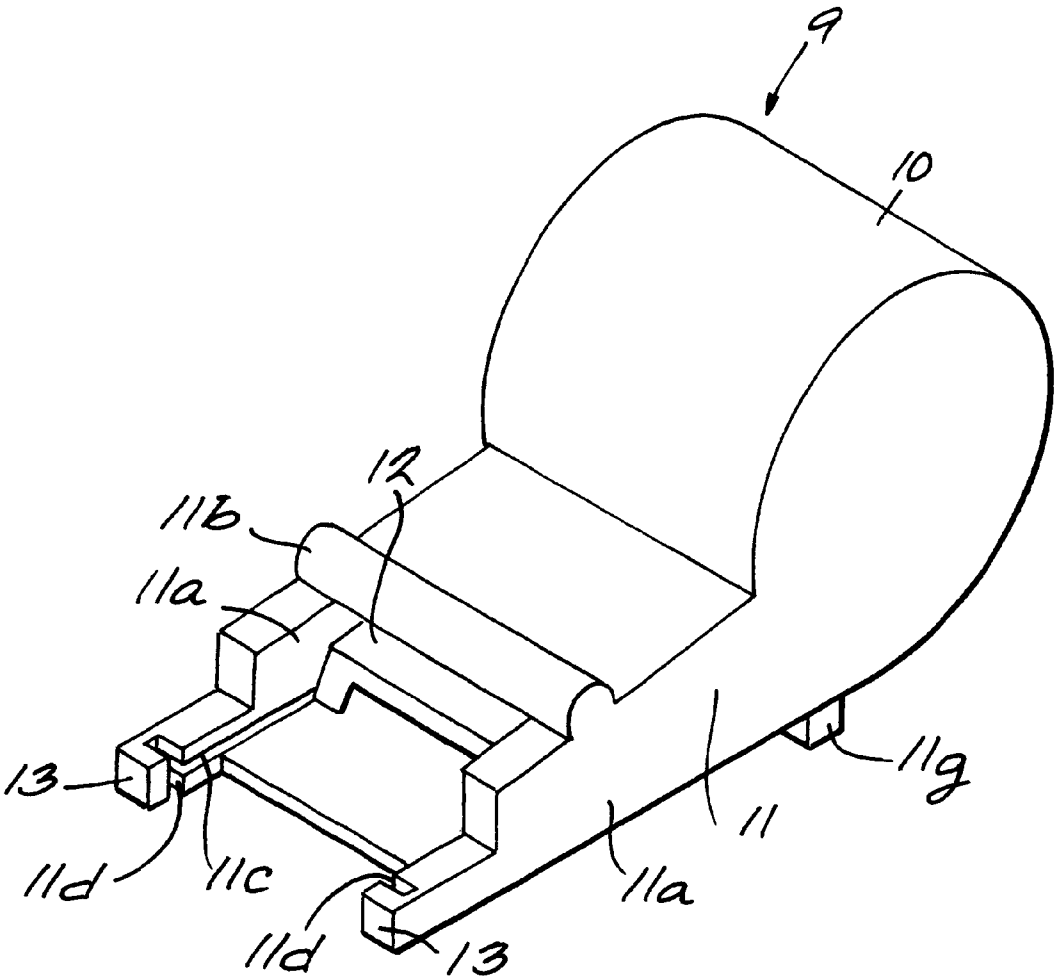
FIG. 3 is a perspective view of the cartridge 9 in the first embodiment of the present invention.

What follows is an explanation of the first embodiment of the present invention with reference to FIG. 2 through FIG. 7. FIG. 2 is a simplified drawing of the entire stapler. The main body of the stapler consists of a frame G. The frame G incorporates the mounting unit 2 and the drive mechanism 4.

The mounting unit 2 contains the cartridge 9 and is equipped with the stapling unit 14. A stack of paper(s) is placed beneath the stapling unit 14, and a staple 1 is inserted into the stack of paper by the stapling unit 14.

The drive mechanism 4 moves the stapling unit 14 up and down, and applies a staple 1 to the stack of paper(s).

The cartridge 9 is equipped with a housing unit 10 for housing a rolled sheet of staples (a) and a guide unit 11 for drawing the end of the rolled sheet of staples (a) out from the cartridge 9.

The housing unit 10 has an outer diameter that conforms to the rolled sheet of staples (a) and a round inner periphery.

The guide unit 11 for guiding the sheet of staples (a) is equipped with a pair of walls 11*a*, 11*a* held apart at a given interval, and a protrusion 11*b* moving horizontally between the walls 11*a*, 11*a*. The protrusion 11*b* has a reverse motion stopping tab 12. The reverse motion stopping tab 12 has a tip that makes contact with the sheet of staples (a) advancing from the guide unit 11.

Guide grooves 11*c*, 11*c* are formed on the inside surface of the walls 11*a*, 11*a*. The guide grooves 11*c*, 11*c* support the sheet of staples (a) The interval between the guide grooves 11*c*, 11*c* has an angular C-shape and is roughly the length of a staple 1.

Stoppers 13, 13 are formed on the edge of the walls 11*a*, 11*a* of the guide unit 11 to block the ends of the guide grooves 11*c*, 11*c*. Release holes 11*d* that open upwardly are formed in the guide grooves 11*c*, 11*c* in front of the stoppers 13, 13.

By forming release holes 11*d*, the sheet of staples (a) drawn out onto the guide unit 11 from the housing unit 10 makes contact with the stoppers 13, 13 at the position of the release holes 11*d* and further movement is prevented. The length between the release holes 11*d* is roughly equivalent to the width of a staple.

A catch 11*g* is located beneath the guide unit 11 to secure the cartridge 9 inside the main body of the device.

Figure 4:
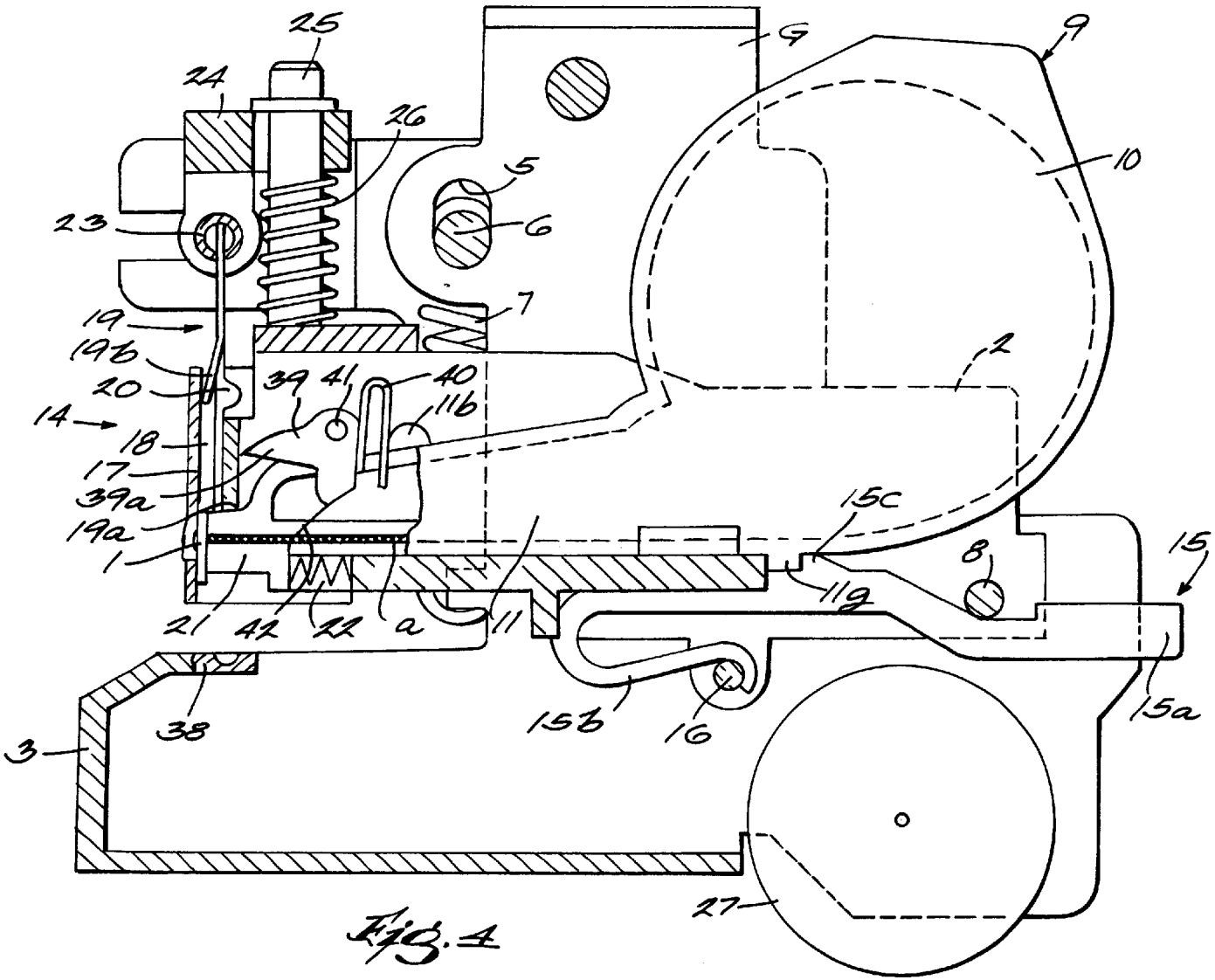
FIG. 4 is a detailed cross-sectional view of the stapler in FIG. 2.

What follows is a detailed explanation of a cartridge 9 installed in the mounting unit 2 with reference to FIG. 4. The mounting unit 2 is attached to the frame G above the base 3. The mounting unit 2 is attached to the shaft 8 on the frame G so as to be able to rotate freely.

When the cartridge 9 is installed in the mounting unit 2, the catch 11*g* on the cartridge 9 is drawn into the lock unit 15 formed in the mounting unit 2. The lock unit 15 is situated on the bottom of the mounting unit 2 and has a handle unit 15*a*, an elastic U-shaped unit 15*b* formed on the tip of the handle unit 15*a*, and a protrusion 15*c* protruding towards the bottom of the mounting unit 2 from the handle unit 15*a*. The tip of the U-shaped unit 15*b* is hung around the pin 16 on the base 3.

When the cartridge 9 is installed in a mounting unit 2 with a lock unit 15, the catch 11*g* on the cartridge 9 applies pressure to the protrusion 15*c* protruding towards the bottom of the mounting unit 2, and surmounts the protrusion 15*c*. Having surmounted the protrusion 15*c*, the cartridge 9 cannot be released because the catch 11*g* engages the protrusion 15*c*. In other words, the cartridge 9 cannot be extracted from the mounting unit 2 because of the lock unit 15.

When the cartridge 9 is removed from the mounting unit 2, the handle unit 15*a* is pressed down manually. When the handle unit 15*a* is pressed down, the end of the U-shaped unit 15*b* is pressed into the pin 16 and the U-shaped unit 15*b* is bent. The protrusion 15*c* is then released by the catch 11*g*. In other words, the handle unit 15*a* is pressed down and the cartridge 9 is removed from the mounting unit 2.

Also, when the cartridge 9 is installed in the mounting unit 2, the end comes into contact with the stapling unit 14. Here, the stapling unit 14 consists of a sheath bracket 17, a former 18 and a driver 19.

Figure 5:
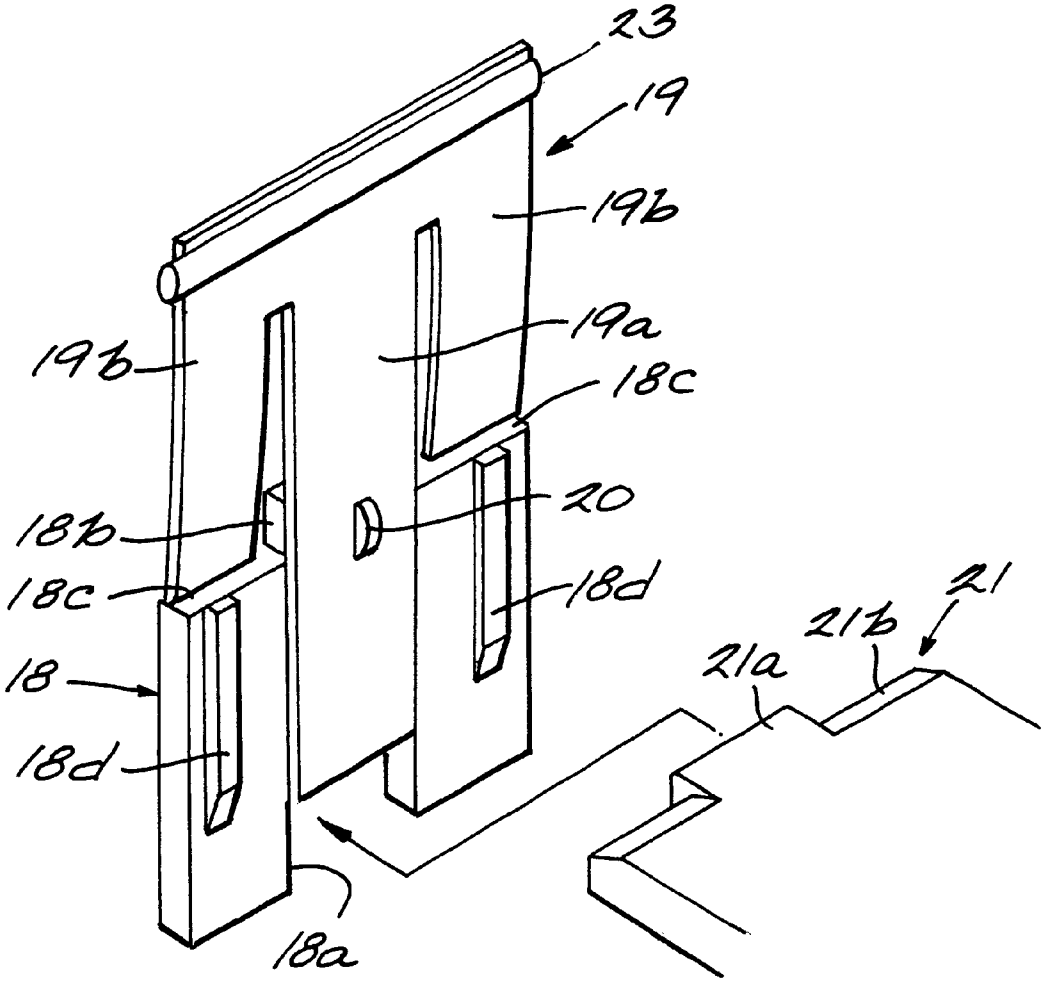
FIG. 5 is an enlarged view of the bending section of the stapler in FIG. 2.

FIG. 5 is a detailed drawing of the stapling unit 14. A depression 18*a* is formed in the bottom of the former 18, and a protrusion 18*b* is formed in the top of the former 18. This forms shoulders 18*c*, 18*c* on both ends.

The driver 19 has a bottom end that is divided into three plates with a long plate 19*a* in the middle and short plates 19*b*, 19*b* on the ends. A protrusion 20 is formed in the middle plate 19*a*, and this protrusion 20 makes contact with the former 18 on the opposite end.

The end of the middle plate 19*a* protrudes into the depression 18*a* in the former 18. The plates 19*b*, 19*b* on the ends are bent into a wedge shape, and the ends come into contact with the shoulders 18*c*, 18*c* on the former 18.

A bending block 21 is situated in the depression 18*a* of the former 18 and engages it. The bending block 21 has sloping sections 21*b*, 21*b* on both ends of the protrusion 21*a* and the protrusion 21*a* engages the depression 18*a* in the former 18.

As shown in FIG. 4, the bending block 21 is attached to the bottom of the mounting unit 2 via a spring 22, which applies spring action to the left in the drawing. Push units 18*d*, 18*d* are established in the former 18 to make contact with the sloping units 21*b*, 21*b* in the bending block 21. When the push units 18*d*, 18*d* make contact with the sloping units 21*b*, 21*b*, the spring 22 is coiled and the entire bending block 21 moves to the right in the drawing.

Figure 6:
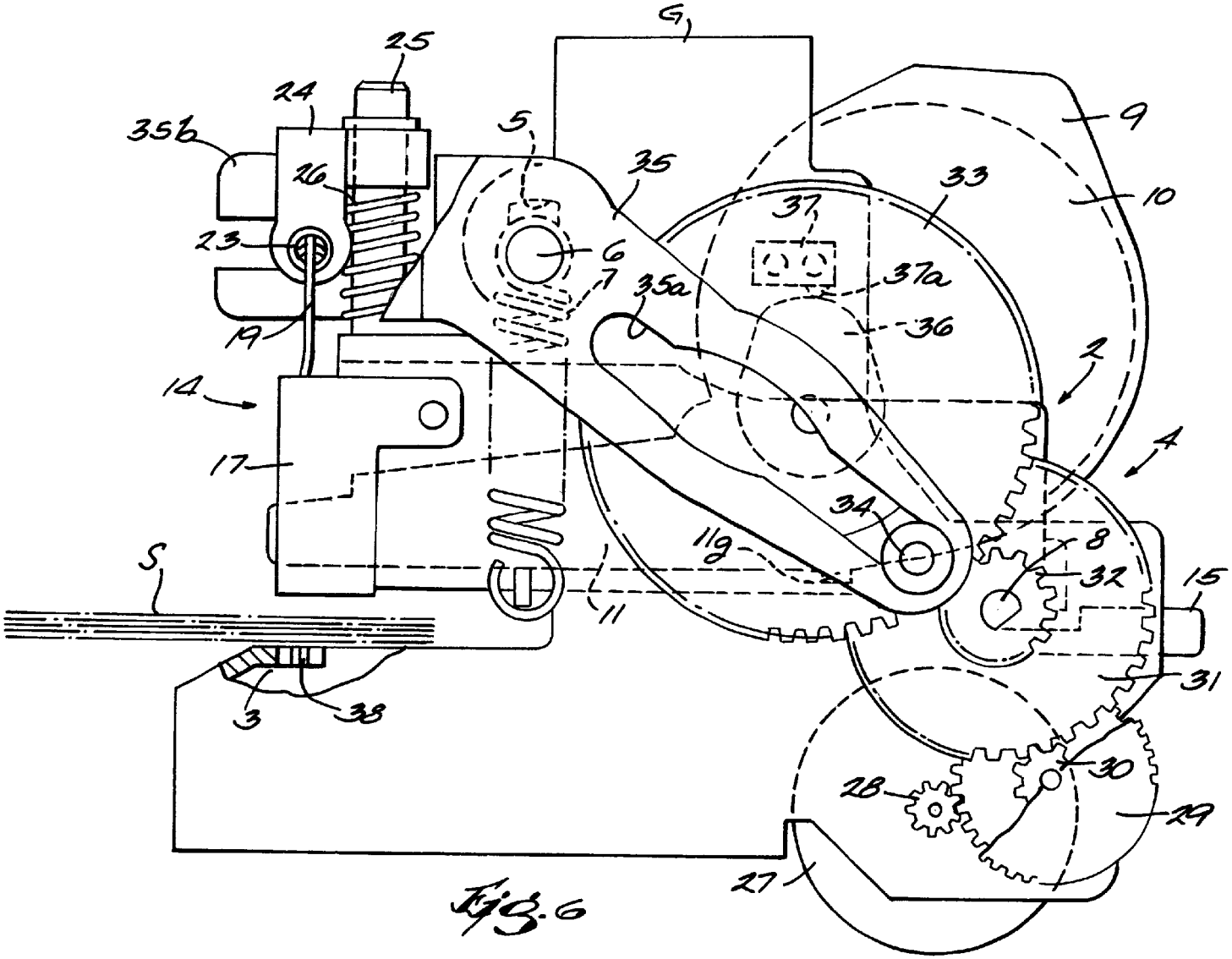
FIG. 6 is a detailed external view of the stapler in FIG. 2.

The top end of the driver 19 is fixed to the shaft 23, and the shaft 23 is connected so the drive mechanism 4 can move it up and down as shown in FIG. 6.

The front block 24 is attached to the shaft 23, and the front block 24 is supported by the spring shaft 25 protruding from the mounting unit 2 so that it can slide. A spring 26 is placed on the spring shaft 25 so as to apply pressure to the mounting unit 2 and the front block 24.

The mounting unit 2 is attached to the shaft 8 so it can rotate freely around the center. When the shaft 23 is raised, the front block 24 is also raised. When the shaft 23 is lowered, the mounting unit 2 is also lowered.

Therefore, when the front block 24 moves down, the mounting unit 2 moves down along the front block without compressing the spring 26 until the mounting unit 2 makes contact with the base 3. However, after the mounting unit 2 makes contact with the base 3, the spring 26 is compressed and the spring shaft 25 slides as the front block 24 moves down.

The raising and lowering of the stapling unit 14 and the mounting unit 2 by the drive mechanism 4 will now be explained in detail with reference to FIG. 6.

The drive mechanism 4 is powered by a motor 27, and the motor 27 is attached beneath the frame G. A long hole 5 is formed upward in the frame G, and a shaft 6 passes through the long hole 5. The shaft 6 passing through the long hole 5 is pressed downward by a spring 7 as shown in the drawing.

The motor 27 attached beneath the frame G has a shaft that protrudes outward from the frame G and the protruding end of the shaft has an attached pinion 28. The pinion 28 engages a relay gear 29.

The relay gear 29 is equipped with a first intermediary gear 30 having a diameter smaller than the relay gear. These two gears rotate concentrically. The relay gear 31 engages the first intermediary gear 30.

The relay gear 31 is equipped with a second intermediary gear 32 having a diameter smaller than the relay gear. These two gears also rotate concentrically. A drive gear 33 engages the second intermediate gear 32.

A pin 34 is located in the side of the drive gear 33. The pin 34 is inserted into the cam ring hole 35*a* in the cam ring 35. The cam ring 35 is supported by the shaft 6 attached to the frame G so as to be able to freely rotate. The shaft 6 is interposed, and an interposed support unit 35*b* is formed on the opposite side of the cam ring hole 35*a* to support the interposition of shaft 23.

The drive mechanism 4 has the same configuration on the other side of the frame G (not shown). In the drive mechanism 4, the rotation of the drive gear 33 rotates the pin 34 and shaft 6 moves the cam ring 35 up and down along the center line. In other words, the rotation of the pin 34 moves the cam ring hole 35*a* in the cam ring 35 upwards. The shaft 6 is interposed and the interposed support unit 35*b* on the opposite end is lowered. When the cam ring hole 25*a* is lowered, the interposed support unit 35*b* is raised.

A concentrically rotating cam 36 is situated on the drive gear 33, and the cam 36 presses the position detector 37*a* on the home position switch 37 on the frame G. When the stapling operation begins, the former 18 and driver 19 are in the initial position and the stapling operation is initiated if the cam 36 is making contact with the position detector 37*a* on the home position switch 37. If the cam 36 is not making contact with the position detector 37*a*, the motor 27 continues to rotate until contact is made. When the cam 36 makes contact with the position detector 37*a*, the stapling operation is initiated.

If the interposed support unit 35*b* is at the highest point when the cam 36 makes contact with the position detector 37*a*, the shaft 23 has also moved to the highest point.

The following is a detailed explanation of the feed mechanism for the sheet of staples (a) with reference to FIG. 4. The stapler performing the stapling operation described above has a feed mechanism to advance the staples. The feed mechanism is at the end of the mounting unit and consists of an advancing unit 39, a plate spring 40 and an advancing tab 42.

When a cartridge 9 is installed in the mounting unit 2, the protrusion 11*b* on the cartridge 9 makes contact with one end of the plate spring 40. The other end of the plate spring 40 makes contact with the advancing unit 39.

The advancing unit 39 is mounted on a shaft 41 connected to the mounting unit 2 so as to freely rotate. An advancing tab 42 is attached to the bottom. The end of the advancing tab 42 makes contact with the sheet of staples (a) drawn by the guide unit 11 from the cartridge 9, and the advancing tab 42 is positioned at a shallow angle with respect to the sheet of staples (a) moving in the forward direction.

A protrusion 39*a* is formed in the advancing unit 39. The protrusion 39*a* is positioned just beneath the driver 19 when the cartridge 9 is installed.

When the driver 19 is lowered, the protrusion 20 on the driver 19 makes contact with the protrusion 39*a* on the advancing unit 39. This applies pressure rightward in the drawing. Under pressure, the advancing unit 39 moves to the right while bending the plate spring 40. When the advancing unit 39 moves to the right, the advancing tab 42 also moves to the right over the sheet of staples (a). The amount of movement is equal to the width of a single staple.

When a staple 1 has been applied to a stack of paper(s) and the driver 19 is raised, the pressure on the protrusion 39*a* in the advancing unit 39 is released, and the plate spring 40 returns to its original shape.

When the plate spring 40 returns to its original shape, the advancing tab 42 which had moved to the right in the drawing then moves to the left. When the advancing tab 42 returns to its original position on the left, the tip of the advancing tab 42 engages a staple 1. As the advancing tab 42 moves to the left, the staple also moves to the left.

In other words, the movement from the right to the left by the advancing tab 42 draws a single staple from the housing unit 10 in the cartridge 9. The staple at the end of the guide unit 11 on the cartridge 9 is then moved to the stapling unit 14.

The staple 1 is advanced to the stapling unit 14 as the stack of paper (s) is being stapled.

What follows is an explanation of the operation of the stapler. In a stapler with the configuration shown in FIG. 6, a stack of paper(s) is placed on the base 3, and a cartridge 9 is installed in the mounting unit 2. At this time, the bending block 21 is positioned above the stack of paper(s). A staple 1 is positioned above the stack, and the former 18 and driver 19 are positioned above the staple.

Here, the cartridge 9 is installed in the mounting unit 2 and the drive mechanism 4 is operated.

When the motor 27 for the drive mechanism 4 is operated, the home position switch 37 and cam 36 are positioned above the shaft 23 in the initial position. The drive mechanism 4 is then operated to lower the shaft 23 from the initial position.

When the drive mechanism 4 is operated, the gears engage and rotate. Finally, the drive gear 33 is rotated. When the drive gear 33 rotates, the pin 34 also rotates. The rotation of the pin 34 rotates the cam ring 35 around the shaft 6 and lowers the interposed support unit 35*b*. When the interposed support unit 35*b* is lowered, the shaft 23 it supports is also lowered.

When the shaft 23 is lowered, the driver 19 it supports is lowered (see FIG. 4 and FIG. 5). When the driver 19 is lowered, the plates 19*b*, 19*b* on both ends press down on the shoulders 18*c*, 18*c* of the former 18, and the entire former 18 is pressed down. The long plate 19*a* in the driver 19 is inserted into the depression 18*a* of the former 18.

The lowering of the shaft 23 also lowers the front block 24. The front block 24 lowers the mounting unit 2 via the spring 7. The mounting unit 2 is lowered while maintaining a set distance from the front block 24 and not compressing the spring 7 until the bottom makes contact with the base 11.

When the cam ring 35 is rotated and the shaft 23 is lowered, the bending block 21 engages the depression 18*a* in the former 18.

Here, the staple 1 at the end of the sheet of staples (a) is positioned between the former 18 and the bending block 21. Therefore, when the depression 18*a* in the former 18 engages the bending block 21, the staple 1 is interposed between them. The staple 1 interposed between the former 18 and the bending block 21 is then bent into an angular C-shape by the depression 18*a* in the former 18. The ends of the staple 1 bent into an angular C-shape are then thrust downward from the release holes 11*d* in the cartridge 9.

When the cam ring 35 is rotated and the shaft 23 is lowered, the mounting unit 2 is also lowered and the mounting unit 2 is brought into contact with the base 3. Even when the mounting unit 2 is brought into contact with the base 3, the cam ring 35 is rotated and the shaft 23 lowered. The shaft 23 is lowered as the spring 26 is compressed by the front block 24. When the shaft 23 is lowered as the spring 26 is compressed, the driver 19 is also lowered and the former 18 is pressed downward.

When the former 18 is lowered, the push units 18*d* on both ends of the former 18 make contact with the sloping sections 21*a* on the bending block 21. When the push units 18*d* make contact with the sloping sections 21*a*, the former 18 compresses the spring 22 pressed against the bending block 21, and the bending block 21 is pushed to the right in the drawing. The pushed bending block 21 then retreats from beneath the angular C-shaped staple 1.

When the cam ring 35 is rotated, the driver 19 drives both ends of the angular C-shaped staple 1 through the stack of paper(s), and the staple 1 is detached from the sheet of staples (a).

The stack of paper(s) on the base 2 then forms a document 38, and the document 38 is stapled together by pushing the ends of the bent staple 1 through the sheets of paper. After the bent staple 1 has been pushed through the stack of paper(s), the ends of the staple 1 are folded inward. Once the staple 1 has been pushed through the stack of paper(s) and the ends have been folded inward, the stack of paper(s) is stapled.

When the cam ring 35 is rotated, the shaft 23 gradually rises. The shaft 23 rises to the top position and returns to its original position. A single rotation of the cam ring 35, in other words, brings the stapling operation to an end.

In one embodiment, the staple 1 can become jammed if the stapling operation does not proceed smoothly. When a staple 1 becomes jammed, the cartridge 9 is removed from the mounting unit 2 on the frame G and the jammed staple is removed.

Figure 7:
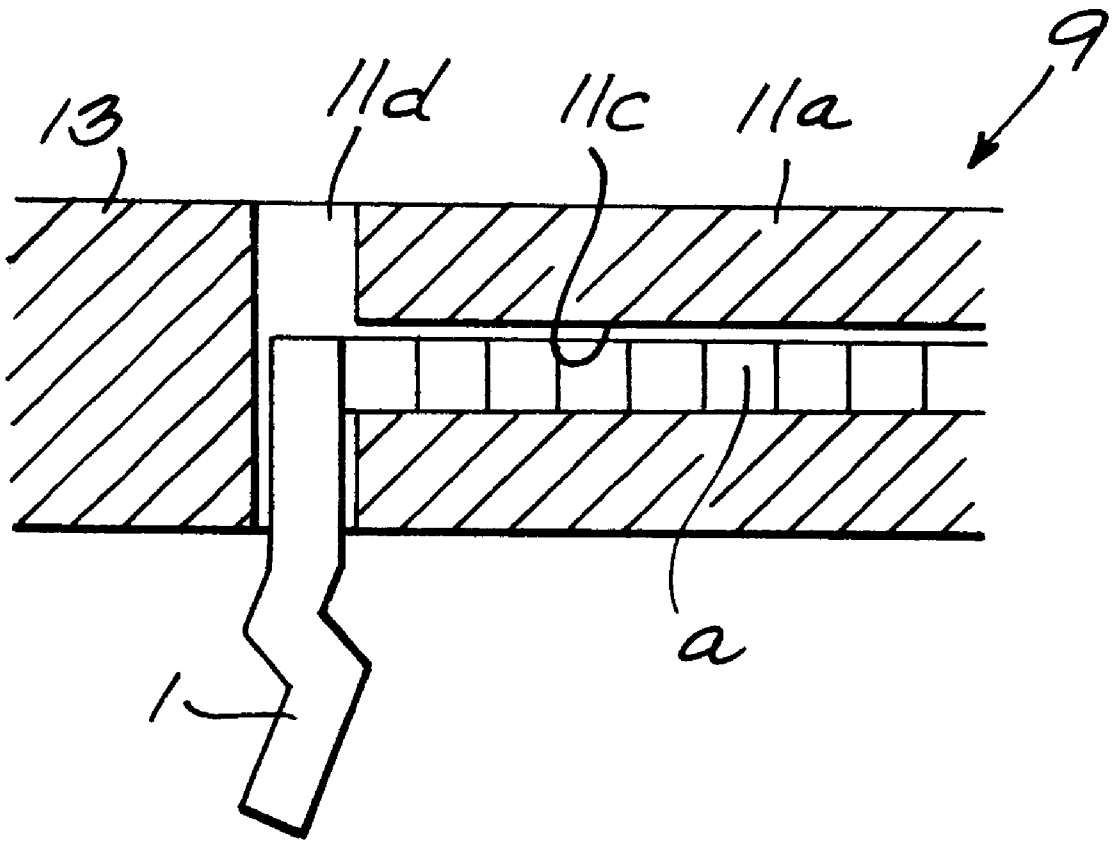
FIG. 7 is an enlarged view of the release hole section in the first embodiment of the present invention.

When the cartridge 9 is removed from the mounting unit 2, as shown in FIG. 7, both ends of the jammed staple 1 extend from the release holes 11*d* in the guide unit. In other words, the staple often becomes jammed after the staple on the sheet of staples (a) has been bent into an angular C-shape by the former 18.

When a staple 1 on the sheet of staples (a) is bent into an angular C-shape by the former 18, the ends of the staple 1 extend from the release holes 11*d*. Because the staple 1 did not pass through the stack of paper(s) smoothly and instead became jammed, the ends of the jammed staple still extend from the release holes 11*d*.

When the jammed staple 1 is to be removed, a finger is used to pull the ends of the staple 1 from the release holes 11*d*.

When a staple 1 becomes jammed during a continuous stapling operation and the jammed staple 1 is pulled out from the ends using a finger, the next staple can be detached during the next stapling sequence without a problem. In other words, when a jammed staple 1 is removed, the next staple is maintained at the proper angle by the release holes 11*d*.

As a result, it is later detached at the proper angle. Therefore, when a jammed staple is removed from the next staple, the sheet of staples (a) does not have to be pulled out, and only the jammed staple 1 is removed.

When a jammed staple is pulled out, bending pressure is brought to bear on the staple next to the jammed staple. The sheet of staples (a) not bent in an angular C-shape have their ends supported by the guide grooves 11*c*, 11*c*. Therefore, when a jammed staple is removed, the next staple is not bent because it is subjected to bending pressure.

In this embodiment, the width of the release holes 11*d* for removing the staple is equivalent to the width of a single staple.

As a result, the jammed staple is removed cleanly without creating any space. Therefore, the removal of a jammed staple does not cause other staples to jam and does not cause the firing of blanks.

Figure 8:
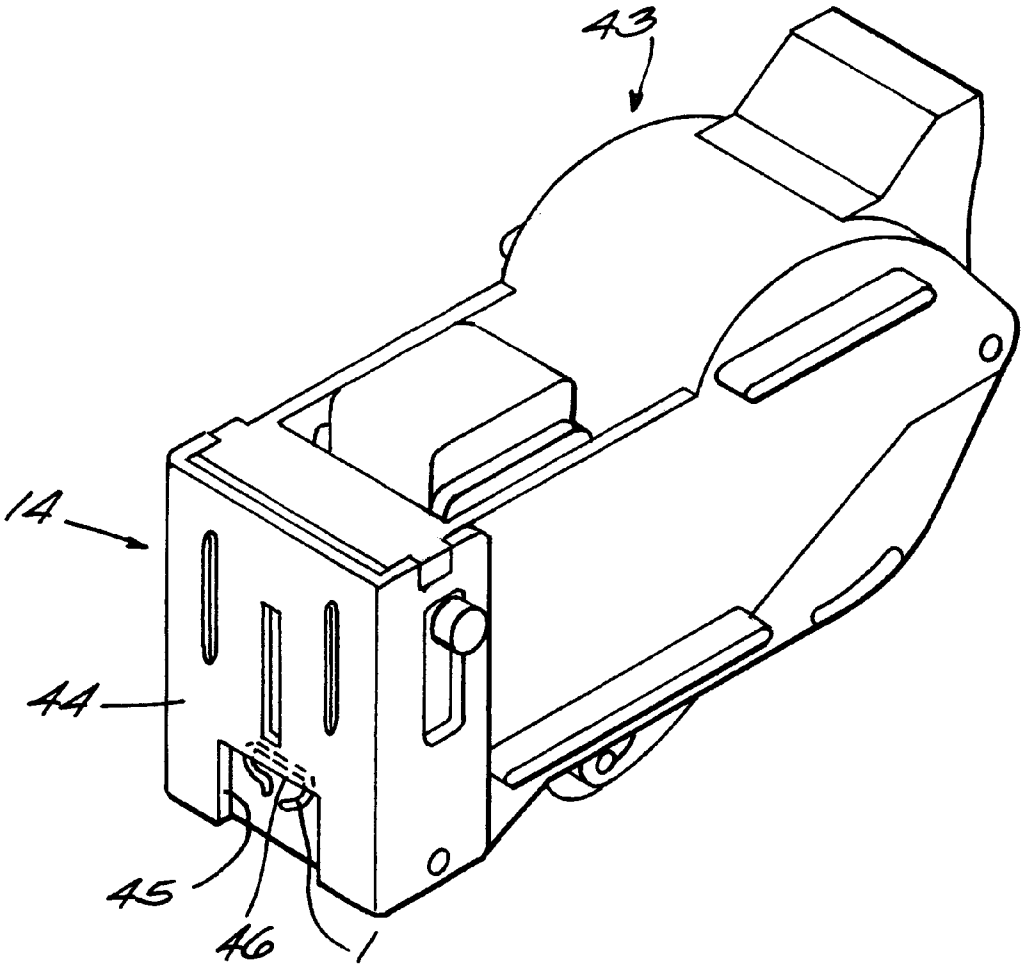
FIG. 8 is an enlarged view of the mounting unit in the second embodiment of the present invention.
Figure 9:
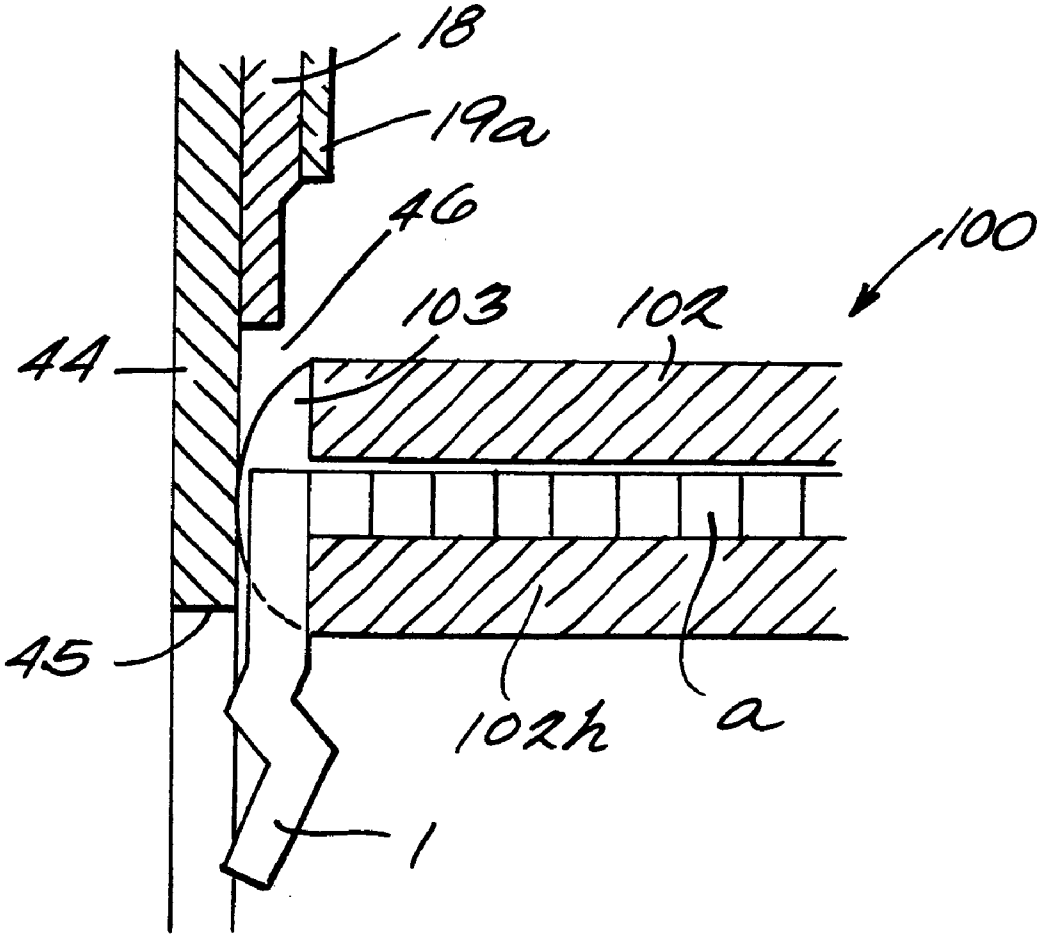
FIG. 9 is an enlarged view of the release hole section in the second embodiment of the present invention.

The second embodiment of the present invention is shown in FIG. 8 and FIG. 9. In the first embodiment, only the end of the cartridge is housed in the mounting unit. In the second embodiment, the entire cartridge is housed in the mounting unit and the mounting unit can be detached from the main body of the device while containing the entire cartridge. Also, in the second embodiment, a stopper is added to keep extra staples from extending outside the sheath bracket of the mounting unit.

In this embodiment, the components identical to those in the first embodiment are denoted by the same numbers. An explanation of the components described in the first embodiment, therefore, has been omitted. The cartridge in the second embodiment of the present invention is the same type used in the prior art. The components identical to those in the prior are denoted by the same numbers. An explanation of these components has also been omitted.

In the second embodiment, the entire cartridge 100 is housed inside the mounting unit 43. A concave opening 45 is formed beneath the sheath bracket 44 of the mounting unit 43. The contact unit 103 at the end of the guide unit 102 on the cartridge 100 comes into contact with the sheath bracket 44 so the contact unit 103 can create an opening between the guide unit 102 and the sheath bracket 44. This opening forms the release holes 46 for removing a jammed staple 1. The length between the release holes 46 is about the same thickness as a single staple 1.

When the cartridge 100 is placed in the mounting unit 43 and the stapling operation is performed, the staple 1 at the end of the sheet of staples (a) comes into contact with the sheath bracket 44. Therefore, in the second embodiment, the sheath bracket 44 acts as a stopper to keep the staples from extending out from the cartridge 100. The staple 1 at the end of the guide 102 is also positioned over the release holes 46.

When the drive mechanism 4 is operated, the former 18 bends the staple 1 into an angular C-shape. Both ends of the bent staple 1 then pass through the release hole 46.

When the staple 1 is bent, the plate 19*a* in the middle of the driver 19 is lowered and the staple 1 is passed through a stack of paper(s). Sometimes, the stapling operation does not go smoothly and the staple 1 becomes jammed.

However, because the ends of the staple 1 extend through the release holes 46 and also extend through the opening 45 in the sheath bracket 44, the jammed staple can be pulled through the opening 45 to remove it.

When the jammed staple is pulled through the opening 45, the sheet of staples (a) attached to the jammed staple 1 is severed from the staple at the angle of the base 102*h* of the guide unit 102. As a result, the unjammed sheet of staples (a) is not pulled out.

When a jammed staple is pulled out, the staple connected to the jammed staple is subjected to bending force. However, the rest of the sheet of staples (a) is supported by the base 102*h* of the guide unit 102. Therefore, when the jammed staple is pulled out, the next staple is subjected to bending force but is not bent.

In the second embodiment, the width of the release holes 46 for removing jammed staples is the thickness of a single staple.

As a result, the jammed staple is removed cleanly without creating any space. Consequently, the removal of a jammed staple does not cause other staples to jam and does not cause the firing of blanks.

Even though the mounting unit 43 is attached to the main body of the device in the second embodiment, jammed staples can be removed in less time.

Figure 10:
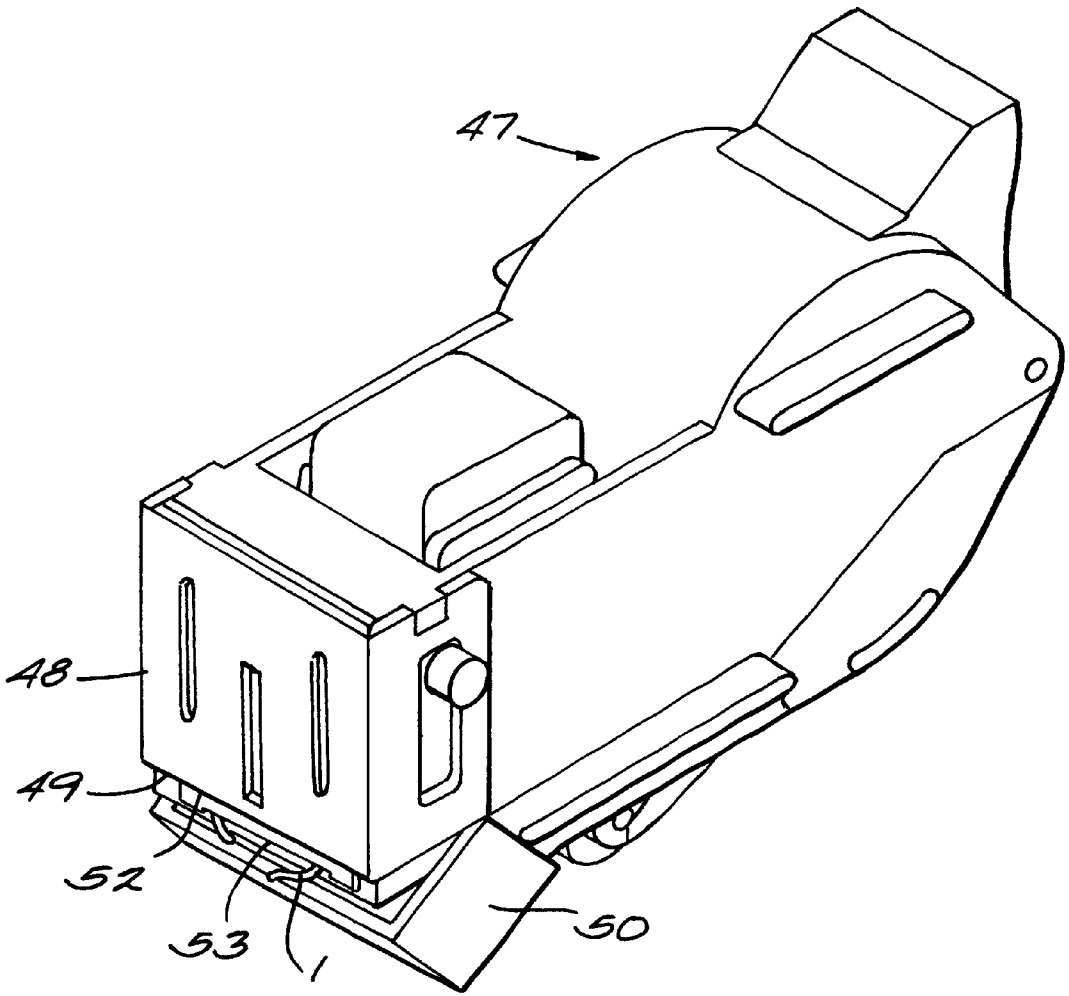
FIG. 10 is an enlarged view of the mounting unit in the third embodiment of the present invention.
Figure 11:
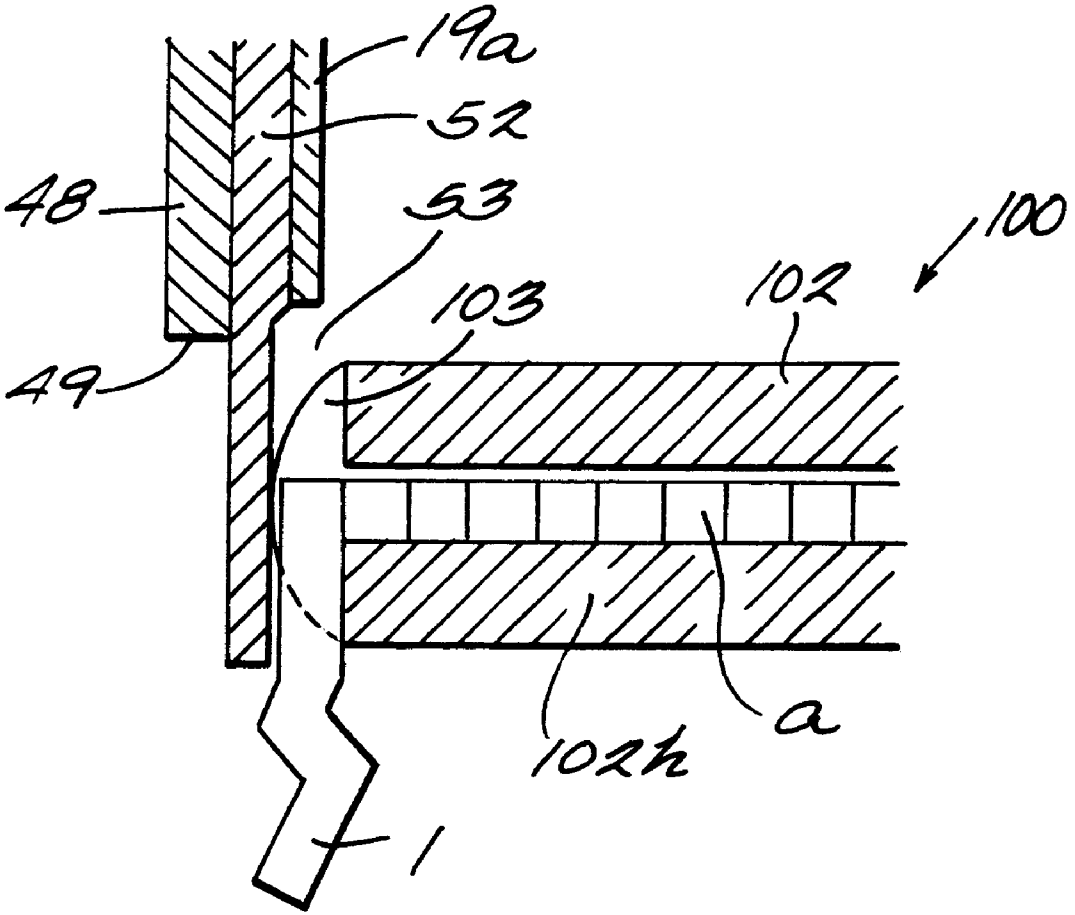
FIG. 11 is an enlarged view of the release hole section of the third embodiment of the present invention.

The third embodiment of the present invention is shown in FIG. 10 and FIG. 11. Here, the entire cartridge is housed in the mounting unit. In this embodiment, a stopper on the mounting unit keeps extra staples from extending outside the sheath bracket of the mounting unit. A rotating cover is also added to the sheath bracket.

In this embodiment, the components identical to those in the first embodiment are denoted by the same numbers. An explanation of the components described in the first embodiment, therefore, has been omitted. The cartridge in this embodiment of the present invention is the same type used in the second embodiment and the prior art. The components identical to those in the prior are denoted by the same numbers. An explanation of these components has also been omitted.

In the third embodiment, the entire cartridge 100 is housed inside the mounting unit 47. An opening 49 is formed beneath the sheath bracket 48 on the mounting unit 47 to keep staples from extending out. A rotatable cover 50 is attached to the opening 49. When the stapling operation is initiated, the opening 49 is covered by the cover 50. This is rotated to expose the opening 49.

When the cartridge 100 is housed inside the mounting unit 47, the contact unit 103 at the end of the guide unit 102 on the cartridge 100 comes into contact with the former 52 so the contact unit 103 can create an opening between the guide unit 102 and the former 52. This opening forms the release hole 53 for removing jammed staples. The width of the release hole 53 in the traveling direction of the staples is about the same thickness as a single staple 1.

The cartridge 100 is placed in the mounting unit 47 and the stapling operation is performed. Sometimes, the stapling operation does not go smoothly and the staple 1 becomes jammed. However, the ends of the staple 1 extend through the release hole 53.

During the stapling operation, the release hole 53 is covered by the cover 50. When a jammed staple has to be removed, the cover 50 is rotated to expose the release hole 53. The jammed staple is then pulled out from the release hole 53.

When the jammed staple is pulled through the opening 53, the sheet of staples (a) attached to the jammed staple 1 is severed from the staple at the angle of the base 102*h* of the guide unit 102. As a result, the unjammed sheet of staples (a) is not pulled out.

When a jammed staple is pulled out, the staple connected to the jammed staple is subjected to bending force. However, the rest of the sheet of staples (a) is supported by the base 102*h* of the guide unit 102. Therefore, when the jammed staple is pulled out, the next staple is subjected to bending force but is not bent.

In the third embodiment, the width of the release hole 53 for removing jammed staples is the thickness of a single staple in the direction the staples move. As a result, the jammed staple is removed cleanly without creating any space. Therefore, the removal of a jammed staple does not cause other staples to jam and does not cause the firing of blanks.

Even though the cartridge 100 and the mounting unit 47 are attached to the main body of the device in the third embodiment, jammed staples can be removed in less time.

In the third embodiment, the cover 50 is attached to the sheath bracket 48 and the cover 50 rotates beneath the mounting unit 47. However, the entire sheath bracket 48 can also be withdrawn above the mounting unit 47 to expose the release hole 53. In other words, any configuration can be used to cover the release hole 53 during the stapling operation and expose the release hole 53 during the jammed staple removal operation.

In the first, second and third embodiments, the size of the release holes 11*d*, 46, 53 was equivalent to the width of a single staple. As a result, only one staple is removed. However, the release holes 11*d*, 46, 53 can be made larger to remove several staples simultaneously.

In the first, second and third embodiments, a stopper was used to restrict the movement of the end of the sheet of staples and stop the end of the sheet of staples adjacent the release holes to allow a jammed staple to be removed through the release holes. In addition, the jammed staple is severed from the sheet of staples at the angle of the release holes. As a result, staples are not wasted and the removal of a jammed staple does not cause other staples to jam and does not cause the firing of blanks.

In the second embodiment and the third embodiment, the stopper and the release holes were formed in the main body of the device. As a result, a jammed staple can be removed more efficiently without having to detach the cartridge.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed:

1. A stapler comprising:

a cartridge having a housing unit for housing a sheet of staples and a guide unit for supporting the sheet of staples drawn from the housing unit; and a main body for accommodating the cartridge, wherein the main body is equipped with a driver mechanism to detach a staple from the sheet of staples and drive the detached staple through a stack of paper and a sheath bracket for guiding the driver mechanism in a direction of the driving motion, wherein a stopper on the guide unit of the cartridge restricts the position of the end of the sheet of staples, and wherein release holes are situated in a position corresponding to the end of the sheet of staples restricted by the stopper so the staple driven by the driver mechanism passes through in the driving direction.

2. The stapler of claim 1, wherein the release holes are substantially at least the same size as a width of a single staple, and are not as large as a width of two staples.

3. The stapler of claim 1, wherein the cartridge can be detached from the main body of the stapler.

4. The stapler of claim 1, wherein the guide unit includes guide grooves that support the sheet of staples in the guide unit.

5. The stapler of claim 4, wherein the release holes communicate with the guide grooves.

6. The stapler of claim 4, wherein the guide grooves extend to a point about one staple-width from the stopper.

7. A stapler comprising:

a cartridge having a housing unit for housing a sheet of staples and a guide unit for supporting the sheet of staples drawn from the housing unit; and a main body for accommodating the cartridge, wherein the main body is equipped with a driver to detach a staple from the sheet of staples and drive the detached staple through a stack of paper, and a sheath for guiding the driver in a direction of the driving motion, wherein a stopper restricts the position of the end of the sheet of staples, and wherein the guide unit supports the sheet of staples to a point about one staple-width from the stopper.

8. The stapler of claim 7, wherein the stopper is on the cartridge.

9. The stapler of claim 7, wherein the guide unit includes guide grooves that support the sheet of staples in the guide unit.

10. The stapler of claim 9, wherein the guide grooves extend to a point about one staple-width from the stopper.

11. The stapler of claim 7, wherein the point about one staple-width from the stopper is less than two staple-widths from the stopper.

12. The stapler of claim 7, wherein the stopper is on the sheath.

13. The stapler of claim 12, wherein release holes are situated in a position corresponding to the end of the sheet of staples restricted by the stopper so the staple driven by the driver mechanism passes through inthe driving direction, and wherein an opening is formed in the sheath, the opening exposing the release holes.

14. The stapler of claim 7, wherein the stopper is on the driver.

15. The stapler of claim 14, wherein release holes are situated in a position corresponding to the end of the sheet of staples restricted by the stopper so the staple driven by the driver mechanism passes through inthe driving direction, wherein an opening is formed in the sheath, and wherein a cover is formed to selectively cover and uncover the opening, the release holes being exposed when the cover is opened and being unexposed when the cover is closed.

16. A staple cartridge comprising:

a housing for housing a sheet of staples; and a guide unit for supporting the sheet of staples drawn from the housing, the guide unit defining a staple pathway and including a stopper defining an end of the staple pathway.

17. The staple cartridge of claim 16, wherein the staple pathway is defined at least partially by opposed walls of the guide unit.

18. The staple cartridge of claim 17, wherein each of the opposed walls includes a guide groove.

19. The staple cartridge of claim 16, wherein the guide unit further includes an aperture adjacent the stopper through which a staple from the sheet of staples can pass.

20. The staple cartridge of claim 19, wherein the aperture is substantially at least the same size as a width of a single staple, and is not as large as a width of two staples.

* * * * *

UNITED STATES PATENT AND TRADEMARK OFFICE

CERTIFICATE OF CORRECTION

PATENT NO. : 6,616,027 B2
DATED : September 9, 2003
INVENTOR(S) : Naoto Mochizuki It is certified that error appears in the above-identified patent and that said Letters Patent is hereby corrected as shown below:

Title page,
Please insert Item -- [30] Foreign Application Priority Data,
Japan 2000-167134 June 5, 2000 --

Column 12,
Lines 2 and 10, "inthe" should be -- in the --.

Signed and Sealed this

Tenth Day of February, 2004

JON W. DUDAS
*Acting Director of the United States Patent and Trademark Office*